United States Patent [19]

Hill

[11] 4,020,730

[45] May 3, 1977

[54] MUSICAL INSTRUMENT

[76] Inventor: Elgie E. Hill, P.O. Box 162, Steelville, Mo. 65565

[22] Filed: Mar. 18, 1976

[21] Appl. No.: 668,230

[52] U.S. Cl. ..... 84/173; 84/174; 84/286

[51] Int. Cl.[2] ..... G10D 1/00

[58] Field of Search ..... 84/173, 284, 285, 286, 84/288, 307, 311, 312, 174, 12

[56] References Cited

UNITED STATES PATENTS

| | | | |
|---|---|---|---|
| 1,750,572 | 3/1930 | Cloetens | 84/173 |
| 2,486,549 | 11/1949 | Bonkowski et al. | 84/173 |
| 2,614,449 | 10/1952 | Machalek | 84/307 |
| 2,837,004 | 6/1958 | Volpe | 84/174 |
| 2,925,006 | 2/1960 | O'Brien | 84/312 |
| 3,358,543 | 12/1967 | Musser | 84/173 |
| 3,780,612 | 12/1973 | Robinson | 84/173 |

*Primary Examiner*—Stephen J. Tomsky
*Attorney, Agent, or Firm*—Cohn, Powell & Hind

[57] ABSTRACT

A stringed musical instrument that can be played in a manner similar to a piano or organ and yet sounds like a guitar. It includes a plurality of string sets extending between and across a pair of string bridges that are mounted on and extend transversely of the instrument body, each string set constituting an octave and being disposed laterally adjacent on the body. Each string set includes a single string that is reversely looped and mounted so that each side of the string can be individually tensioned to provide a different pitch. A plurality of manually operated slide bars are provided, each slide bar extending across and slidably engaging the strings of one string set to achieve selectively the key for the associated string set. Finger-actuating elements are operatively connected to a plurality of string strikers mounted for selectively strinking the strings, the finger-actuating elements selectively moving the string strikers into engagement with the strings. Each string striker is a resilient spring strip having one end attached to the body and an opposite free movable end disposed in an initial position spaced from yet adjacent to one of the strings. A finger-actuated element is operatively engageable with each spring strip to move the free strip end under spring loading into striking engagement with the string.

9 Claims, 6 Drawing Figures

MUSICAL INSTRUMENT

BACKGROUND OF THE INVENTION

This invention relates generally to improvements in a musical instrument, and more particularly to a stringed musical instrument that can be played in a manner similar to a piano or organ and yet produce the sounds similar to that of a guitar.

As is well know, a piano that provides a multiplicity of strings for a plurality of octaves and capable of being played by digitally depressing keys or plungers, is an instrument of relatively large size. Further, a guitar which is a relatively compact instrument is much more restricted in its musical capabilities than a piano because of the limited number of strings and the manner in which the guitar is played.

SUMMARY OF THE INVENTION

The present stringed musical instrument provides all of the advantages of the piano in that a plurality of octaves are provided and that it can be played by digitally depressing keys or plungers, and provides all of the advantages of the guitar in that it produces the sounds of a guitar in a relatively small compact instrument.

The musical instrument has a plurality of string sets extending between and across a pair of string bridges mounted on and extending transversely of the instrument body. Each string set constitutes an octave and is disposed laterally adjacent on the body. A plurality of slide bars are provided, each slide bar extending across and slidably engaging the strings of one string set to achieve selectively the key for the associated string set. Each of the slide bars is mounted for individual, separate sliding movement on its associated string set for selecting a key for the octave of the string set. Obviously, with this structural arrangement, the different string sets tuned for different octaves, can be also tuned by its associated slide bar to the same key as all other string sets or to a key different from that of any other string set, thereby providing a greater flexibility and capability than has been obtained heretofore by the piano or guitar.

The present musical instrument includes a plurality of string strikers that are selectively moved by finger-actuating means into striking engagement with the strings.

The slide bar associated with each string set is slidably mounted to slide rods mounted on the instrument body at each side of each string set, thereby enabling each slide bar to be individually and separately slidable on its associated string set for selecting the key for the octave of the string set.

The instrument body has an opening providing direct access to the slide bars for manipulation to different positions on their associated string sets for key selection for each octave.

Each string striker is a resilient spring strip having one end fastened to the body and an opposite free movable end disposed in an initial position spaced from yet adjacent to one of the strings. The finger-actuating means is operatively engageable with each spring strip to move the free strip end under spring loading into striking engagement with the string, the spring loading of the strip tending to move the strip back to its initial position.

The string strikers are arranged in a pair of spaced rows, the strikers of each row having their free movable ends extending in a direction toward the strikers of the other row, and the strikers of one row engaging string sides or strings different from the strikers of the other row.

Each string set includes a loop peg located outwardly of one string bridge, a pair of adjacent anchor pegs located outwardly of the other string bridge, a string having its ends attached to the anchor pegs and reversely extending about the loop peg, and string-tensioning means operatively connected to each side of the string on opposite sides of the loop peg for individually tensioning each string side to provide a different pitch.

Figure 1:
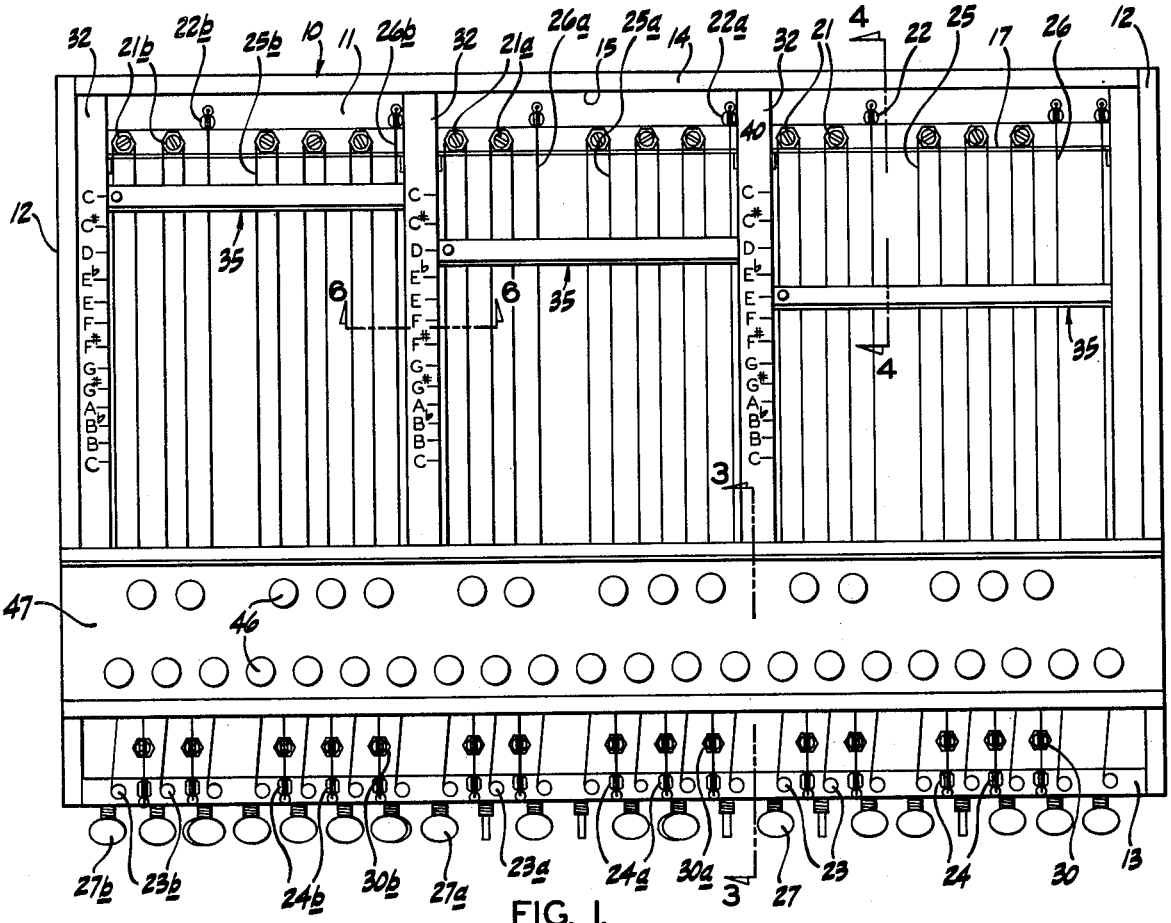
FIG. 1 is a top plan view of the stringed musical instrument.
Figure 2:
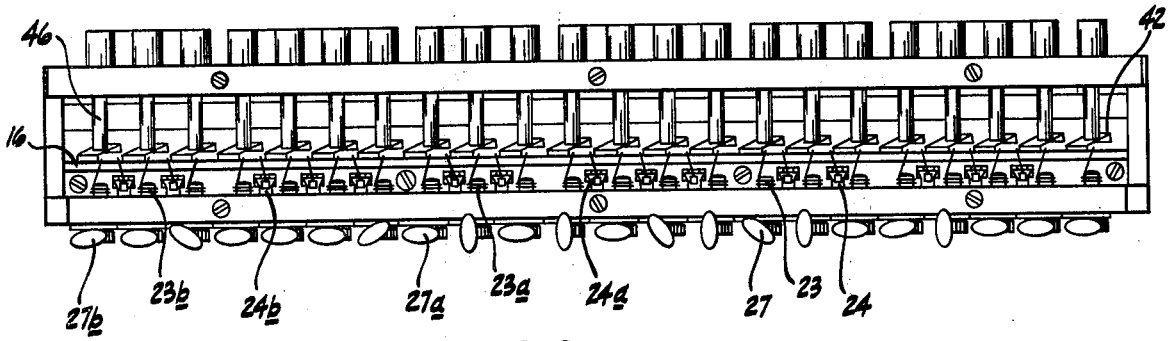
FIG. 2 is a front elevational view thereof.

DESCRIPTION OF THE PREFERRED EMBODIMENT:

Referring now by characters of reference to the drawings, and first to FIGS. 1 and 2, it will be understood that the instrument body generally indicated by 10 includes a substantially rectangular base 11, side walls 12, a front margin 13 and a rear wall 14 interconnected to provide an internal compartment 15.

A pair of string bridges 16 and 17 are mounted on the body base 11 and extend transversely in the body compartment 15 between the side walls 12. Each string bridge 16 and 17 includes a wood member 18 fixed by a plurality of screws 19 to the base 11, and a metal plate 20 fixed to and extending above the wood member 18.

The instrument provides a plurality of string sets located in the internal compartment 15 in side by side relation, each string set constituting an octave. One string set will be described in detail. It will be understood that the components of the other string sets are identical but the reference numbers include the suffix *a* and *b* in order to distinguish.

Each string set includes five loop pegs 21 and two anchor pegs 22 fixed to the wood member 18 of string bridge 17. Attached to the front margin 13 at the opposite side of the other string bridge 16 are seven rotatable key pegs 23, also constituting anchor pegs, and five fixed anchor pegs 24. Mounted on the pegs are five single looped strings 25 and two single span strings 26.

More particularly, each of the single looped strings 25 has one of its ends fixed to a key peg 23 and its other end fixed to an adjacent fixed anchor peg 24, and is reversely extended about a directly opposite loop peg 21. Each of the single span strings 26 has one end attached to a key peg 23 and its other end attached to a directly opposite fixed anchor peg 22.

A string-tensioning means is operatively connected to each side of each looped string 25 for individually tensioning each string side to provide a different pitch.

For example, the key peg 23 to which one string end is attached is operatively connected for rotation by a key 27. Rotation of the key 27 in one direction or the other will cause an increase or decrease respectively in the tension of the particular string side. In addition, fine tuning pegs 30 operatively engage the opposite end of each looped string 25 between its associated anchor peg 24 and adjacent string bridge 16. Rotation of the nut 31 on the threaded fine tuning peg 30 in one direction or the other will cause an increase or decrease respectively in the tension of that side of the looped string 25. With this structural arrangement, each side of the looped string 25 can be individually tensioned to provide a different pitch.

Mounted on the base is a top frame including elongate strips 32 at each side of each string set. Attached to and depending from each of the side strips 32 are a pair of longitudinally spaced mounting blocks 33. Fixed in and extending between each pair of longitudinally spaced mounting blocks 33 is either a single elongate slide rod 34 or a pair of elongate slide rod 34 so as to provide an associate pair of slide 34 at opposite sides of each string set. A slide bar 35 is slidably mounted on the associated pair of slide rods 34 located at opposite sides of each string set, the slide bar 35 extending transversely over and engaging the strings of the associated string set. More particularly, each slide bar includes a wood member 36 and a metal plate 37 that extends below the wood member 36 and engages the strings. The slide bars 35 can be individually slidably positioned on their associated string sets to determine or select the keys for the octaves of the associated string sets. It will be understood that the top frame is open to permit direct manual access to the slide bars 35 for manipulation.

To facilitate the positioning of each slide bar 35, a key scale indicia 40 is provided on a side strip 32 adjacent each string set, and an indicator 41 is carried by the adjacent associated slide bar 35. The indicator 41 will visually indicate on the scale indicia 40 the particular key for the octave of that string set when the strings have been appropriately tuned.

Figure 3:
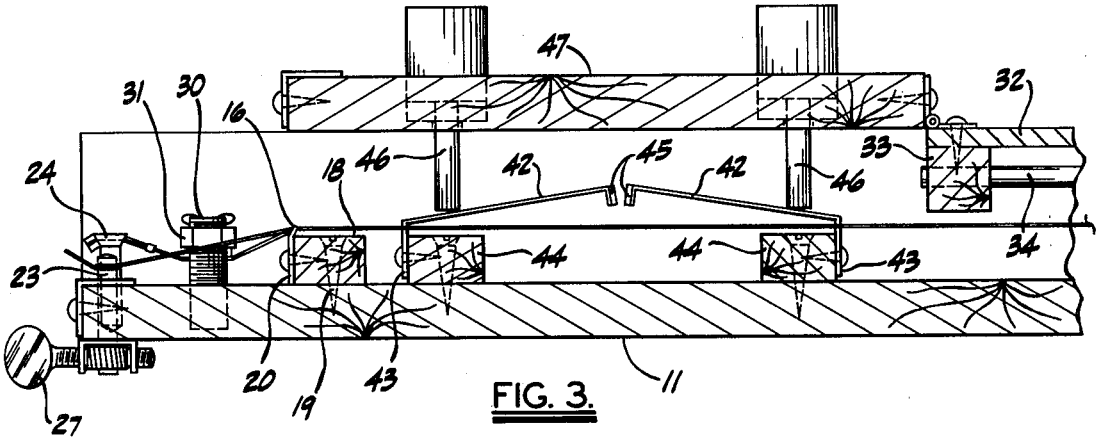
FIG. 3 is an enlarged cross sectional view as taken on line 3—3 of FIG. 1.
Figure 4:
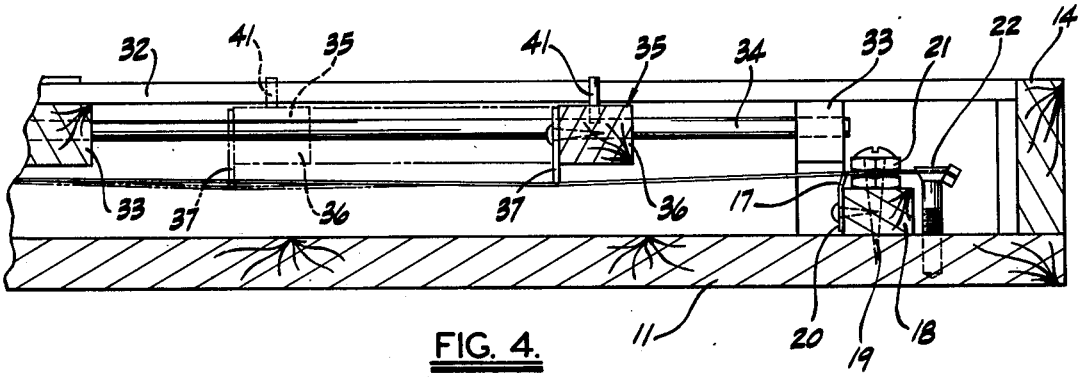
FIG. 4 is an enlarged cross sectional view as taken on line 4—4 of FIG. 1.
Figure 5:
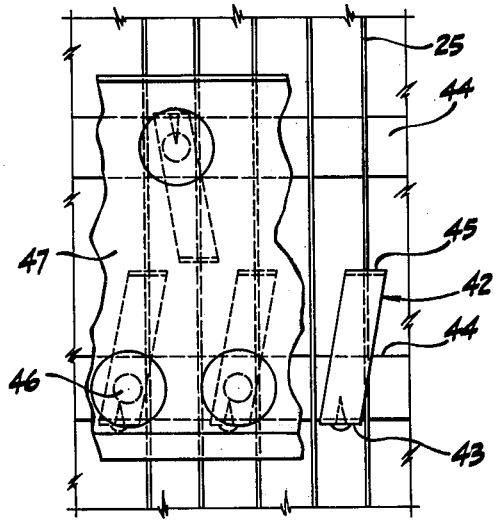
FIG. 5 is a fragmentary, top plan view as taken from FIG. 3.
Figure 6:
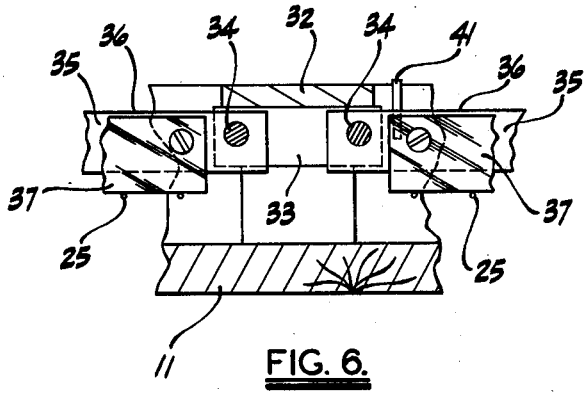
FIG. 6 is an enlarged cross sectional view as taken on line 6—6 of FIG. 1.

The string strikers 42 are best illustrated in FIGS. 3 and 5. Each string striker 42 is a resilient spring strip having one end 43 attached to a block 44 fixed to the body base 11, and an opposite free movable end 45 disposed in an initial position spaced from yet adjacent to one of the strings. The string strikers 42 are arranged in a pair of spaced rows, the strikers 42 of each row having their free movable ends 45 extending in a direction toward the strikers of the other row. The strikers of one row engage string sides or strings different from the strikers 42 of the other row.

Finger-actuating means is operatively connected to the string strikers 42 for selectively moving the strikers 42 into engagement with the strings. In the embodiment disclosed, the finger-actuating means includes a plurality of plungers 46 reciprocatively mounted on and in a board 47 hinged to the top frame. Each of the plungers 46 is engageable with one of the spring strips constituting a string striker 42 to move the free strip end 45 into engagement with the associated adjacent string. For example, when one of the plungers 46 is depressed digitally, it will move the free strip end 45 under spring loading into striking engagement with the string. When digital pressure is removed from the plunger 46, the spring loading of the strip will move the free strip end 45 back to its initial position. Of course, it will be understood that the finger-actuating means could be elements similar to piano keys instead of buttons.

After the strings of each string set are appropriately connected to the anchor pegs 23–24 and extended reversely about the loop pegs 21 in the manner previously described and as shown in the drawings, the strings can be then appropriately tuned. With the slide bar 35 located in the position for the key of A for instance, the keys 27 and the fine tuning pegs 30 are then adjusted to provide the proper pitches. This adjustment is made for each octave as provided by the different string sets.

After the instrument has been appropriately tuned, it is played by digitally striking and depressing the plungers 46. As described in greater detail previously, when a plunger 46 is depressed, it will move its associated striker 42 into engagement with its associated string to produce the desired sound. Of course, it will be understood that the slide bars 35 can be positioned individually at any selected key for each octave even while the composition is being played, thereby providing a great flexibility in attainment of unique sound production. The instrument can be played in the manner of a piano, yet provides the sounds of a stringed guitar.

I claim as my invention:

1. In a musical instrument:

a. a body, b. a pair of string bridges mounted on and extending transversely of the body, c. a plurality of string sets extending between and across the string bridges, each string set constituting an octave and being disposed laterally adjacent on the body, d. a plurality of slide bars mounted on the body, each slide bar extending across and slidably engaging the strings of one string set to achieve selectively the key for the associated string set, e. a plurality of string strikers mounted on the body for selectively striking the strings, and f. finger-actuating means operatively connected to the string strikers for selectively moving the string strikers into engagement with the strings.

2. A musical instrument as defined in claim 1, in which:

g. each of the slide bars is mounted on the body for individual, separate sliding movement on its associated string set for selecting a key for the octave of said string set.

3. A musical instrument as defined in claim 1, in which:

g. a slide rod is mounted on the body at each side of each string set, h. the slide bar associated with each string set is slidably mounted to the slide rods at opposite sides of said string set, and i. each slide bar is individually and separately slidable on its associated string set for selecting a key for the octave of said string set.

4. A musical instrument as defined in claim 2, in which:

h. the body has an opening providing direct access to the slide bars for manipulation to different positions on their associated string sets for key selection for each octave.

5. A musical instrument as defined in claim 1, in which:

g. each string striker is a resilient spring strip having one end attached to the body and an opposite free movable end disposed in an initial position spaced from yet adjacent to one of the strings, and h. the finger-actuating means is operatively engageable with each spring strip to move the free strip end under spring loading into striking engagement with the string, the spring loading of the strip tending to move the strip back to its initial position.

6. A musical instrument as defined in claim 5, in which:

i. the string strikers are arranged in a pair of spaced rows, the strikers of each row having their free movable ends extending in a direction toward the strikers of the other row, and the strikers of one row engaging strings different from the strikers of the other row.

7. A musical instrument as defined in claim 5, in which:

i. the finger-actuating means includes a plurality of plungers, each of the plungers being engageable with one of the spring strips to move the free strip end into striking engagement with the associated adjacent string.

8. A musical instrument as defined in claim 1, in which:

g. each string set includes:

1. a loop peg located outwardly of one string bridge,
2. a pair of adjacent anchor pegs located outwardly of the other string bridge,
3. a string having its ends attached to the anchor pegs and reversely extending about the loop peg, and
4. string-tensioning means operatively connected to each side of the string on opposite sides of the loop peg for individually tensioning each string side to provide a different pitch.

9. In a musical instrument:

a. a body, b. a pair of string bridges mounted on and extending transversely of the body, c. a plurality of string sets extending between and across the string bridges, each string set constituting an octave and being disposed laterally adjacent on the body, d. slide bar means mounted on the body and extending across and slideably engaging the strings of the string sets to achieve selectively the key for the string sets, e. a plurality of string strikers mounted on the body for selectively striking the strings, and f. finger-actuating means operatively connected to the string strikers for selectively moving the string strikers into engagement with the strings.

* * * * *